US006668519B2

(12) United States Patent
Richey

(10) Patent No.: US 6,668,519 B2
(45) Date of Patent: Dec. 30, 2003

(54) METHOD AND APPARATUS FOR PACKAGING OBJECTS IN A SHIPPING CONTAINER

(75) Inventor: Troy Richey, Upper Sandusky, OH (US)

(73) Assignee: Buckeye Machine Fabricators, Inc., Forest, OH (US)

( * ) Notice: Subject to any disclaimer, the term of this patent is extended or adjusted under 35 U.S.C. 154(b) by 17 days.

(21) Appl. No.: 10/361,094

(22) Filed: Feb. 7, 2003

(65) Prior Publication Data

US 2003/0115833 A1 Jun. 26, 2003

Related U.S. Application Data

(63) Continuation of application No. 09/638,612, filed on Aug. 15, 2000.

(60) Provisional application No. 60/179,702, filed on Feb. 1, 2000.

(51) Int. Cl.[7] ..... B65B 61/00

(52) U.S. Cl. ..... 53/139.7; 53/255; 53/261; 53/248; 53/570

(58) Field of Search ..... 53/457, 459, 139.5, 53/248, 255, 257, 381.1, 384.1, 570, 261, 139.7, 571, 469

(56) References Cited

U.S. PATENT DOCUMENTS

| | | | | |
|---|---|---|---|---|
| 1,639,487 | A | | 8/1927 | Collis |
| 1,786,189 | A | | 12/1930 | Bowersock |
| 2,031,005 | A | | 2/1936 | Renfroe |
| 2,340,387 | A | | 1/1944 | Hummel |
| 2,342,369 | A | | 2/1944 | Ransbottom |
| 2,403,149 | A | | 7/1946 | Williams et al. |
| 2,575,784 | A | | 11/1951 | Baumann |
| 2,608,332 | A | | 8/1952 | Pottle |
| 2,713,449 | A | | 7/1955 | Carmichael |
| 2,969,629 | A | | 1/1961 | Blais |
| 3,072,313 | A | | 1/1963 | Svendsen |
| 3,269,430 | A | * | 8/1966 | Belk ..... 53/384.1 |
| 3,504,842 | A | | 4/1970 | Grafslund |
| 3,522,688 | A | | 8/1970 | Kaliwoda et al. |
| 3,581,458 | A | | 6/1971 | Gustavsson |
| 3,650,775 | A | | 3/1972 | Simon et al. |
| 3,734,389 | A | | 5/1973 | Brown |
| 3,835,986 | A | | 9/1974 | LeBeau |
| 3,891,086 | A | | 6/1975 | Isaacs |
| 4,050,219 | A | | 9/1977 | Higgins |
| 4,226,327 | A | | 10/1980 | Ballard |
| 4,228,635 | A | | 10/1980 | Altenpohl et al. |
| 4,245,453 | A | | 1/1981 | Altenophl et al. |
| 4,610,355 | A | | 9/1986 | Maurer |
| 4,651,506 | A | * | 3/1987 | Lerner et al. ..... 53/459 |
| 4,687,462 | A | * | 8/1987 | Rewitzer ..... 53/384.1 |
| 4,717,025 | A | | 1/1988 | Maurer |
| 4,811,840 | A | | 3/1989 | Muyskens |
| 4,881,641 | A | | 11/1989 | Mattingly et al. |
| 4,919,263 | A | | 4/1990 | Baltzer et al. |
| 4,955,474 | A | | 9/1990 | Mattingly et al. |
| 5,048,266 | A | | 9/1991 | Wieckowicz |

(List continued on next page.)

*Primary Examiner*—John Sipos
*Assistant Examiner*—Louis Huynh
(74) *Attorney, Agent, or Firm*—Emch, Schaffer, Schaub & Porcello Co., L.P.A.

(57) ABSTRACT

A method and apparatus for providing a shipping container for holding an object has a base for receiving the article is described. A plurality of corner posts is affixed to the base. Each post has a first end affixed to a portion of the base and a second, opposed end in a spaced apart relationship to the base. A flexible material is positioned over the base and corner posts. The flexible material is capable of being removed from the base and corner posts without being torn or destroyed. The object is positioned in a shipping container by positioning the object on the base and positioning the posts adjacent corners of the object. The base with the corner posts affixed thereto is placed in a flexible material having an open end and a closed end. A removable top is secured to the corner posts.

18 Claims, 13 Drawing Sheets

U.S. PATENT DOCUMENTS

| | | | |
|---|---|---|---|
| 5,161,692 | A | 11/1992 | Knierim |
| 5,277,310 | A | 1/1994 | Mertz |
| 5,289,969 | A | 3/1994 | Schwaner |
| 5,307,928 | A | 5/1994 | Bishop |
| 5,322,212 | A | 6/1994 | Strasevicz et al. |
| 5,435,114 | A | 7/1995 | Moehlenbrock et al. |
| 5,435,441 | A | 7/1995 | Tiedt et al. |
| 5,473,869 | A | 12/1995 | Chikatani |
| 5,535,572 | A | 7/1996 | Morantz et al. |
| 5,573,176 | A | 11/1996 | Applegate |
| 5,579,991 | A | 12/1996 | Strasevicz et al. |
| 5,593,039 | A | 1/1997 | Ortlieb |
| 5,595,051 | A | 1/1997 | Applegate |
| 5,669,496 | A | 9/1997 | Daniels |
| 5,701,999 | A | 12/1997 | Phillips, II, et al. |
| 5,730,295 | A | 3/1998 | Darby |
| 5,735,404 | A | 4/1998 | Kumakura et al. |
| 5,813,169 | A | 9/1998 | Engerman |
| 5,813,537 | A | 9/1998 | DeReu et al. |
| 5,831,811 | A | 11/1998 | Van Horn |
| 5,837,336 | A | 11/1998 | Ichimura et al. |
| RE35,976 | E | 12/1998 | Gasparrini et al. |
| 5,862,911 | A | 1/1999 | Phillips, II, et al. |
| 5,871,099 | A | 2/1999 | Mellenthin et al. |
| 6,178,721 | B1 | 1/2001 | Turfan |

* cited by examiner

METHOD AND APPARATUS FOR PACKAGING OBJECTS IN A SHIPPING CONTAINER

RELATED APPLICATION

This is a continuation of co-pending application, Ser. No. 09/638,612 filed Aug. 15, 2000, which is expressly incorporated herein by reference.

The present application is related to and claims priority based upon provisional application Ser. No. 60/179,702, filed Feb. 1, 2000.

TECHNICAL FIELD

The present invention relates in general to packaging, and more particularly to a method and apparatus for packaging and shipping large objects such as household appliances, rolls of paper, carpet, race cars, boats and the like in a transparent container without the use of heat shrink materials.

BACKGROUND OF THE INVENTION

Recently, industries are requiring that their manufactured objects be visible during shipping. If any damage has occurred to the object, such damage would be immediately visible. Also, it has been determined that when the object is visible in the packaging, more care is given to the object being shipped and less damage, in fact, occurs.

Industries are also requiring that the shipping containers have a reduced amount of packaging material in order to comply with other types of loading devices which do not crush under the shrinking plastic. Prior art references include U.S. Pat. Nos. 5,862,911; 5,701,999; 5,307,928; 5,289,969; 5,277,310; 4,919,263; 4,811,840; 4,226,327; 3,891,086; 3,835,986; 3,581,458 and 3,522,688. While the prior art packages allow the object to be seen, any attempt to physically examine the object within the container requires the destruction of the plastic covering.

Still another requirement is that if damage has occurred to the object, it is important to be able to gain access to the object without destruction of the entire package. Shrink wrap packages and cardboard packaging material are typically destroyed when entry into the package is attempted.

Accordingly, it is desired to have a method for making a shipping container which protects objects during shipping, uses a minimal amount of packaging material, allows the object to be visible, and which further allows access to the object without destruction of the shipping container.

It would be also desirable to provide a see-through shipping container which is capable of being temporarily removed from the object and replaced on the object without destruction of the container.

It is an object of the present invention to provide an economical method for providing a transparent shipping container that is easily adapted to automatic packaging systems.

It is a further object to provide an improved method for packing objects which allows the objects to be readily handled by forklift, trucks and the like.

It is a further object to provide a method for packaging objects using a container which is economically constructed from a minimum number of components.

It is a further object to provide an improved method for packaging of heavy articles such as kitchen appliances and the like.

It is another object to provide an improved method for packaging objects which allows the object in the shipping container to be physically examined after having been packaged in the shipping container without destruction of the shipping container and to be repackaged in the same shipping container.

SUMMARY OF THE INVENTION

The present invention relates to a method and apparatus for packaging an object in a shipping container. The container has a base for receiving the article and a plurality of corner posts connected to the base. Each post has a first end affixed to a portion of the base and a second, opposed end in a spaced apart relationship to the base. A flexible material is positioned over the base and corner posts. It is preferred that the flexible material is translucent or transparent. The flexible material is capable of being removed from the base and corner posts without being torn or destroyed. The object being shipped is placed on the base and within the flexible material. A removable top is positioned over the flexible material.

The present invention also relates to a method for removably storing an object in a shipping container without destruction of the shipping container. The method includes securing a plurality of corner posts to a base. The object to be shipped is positioned on the base/corner posts component. The corner posts are then positioned adjacent the corners of the object. The object/base/corner posts assembly or component is placed in a flexible material having an open end and a closed end. In a preferred method, the object/base/corner posts assembly or component is dropped or slideably placed into the open end of the flexible material. The flexible material is a non-heat shrink plastic transparent or translucent material. Thereafter, a removable top is secured to the flexible material and the base/corner posts assembly by at least one securing means. The securing means is removable to allow the flexible material to be slideably removed from the corner posts to allow access to the object.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1A:
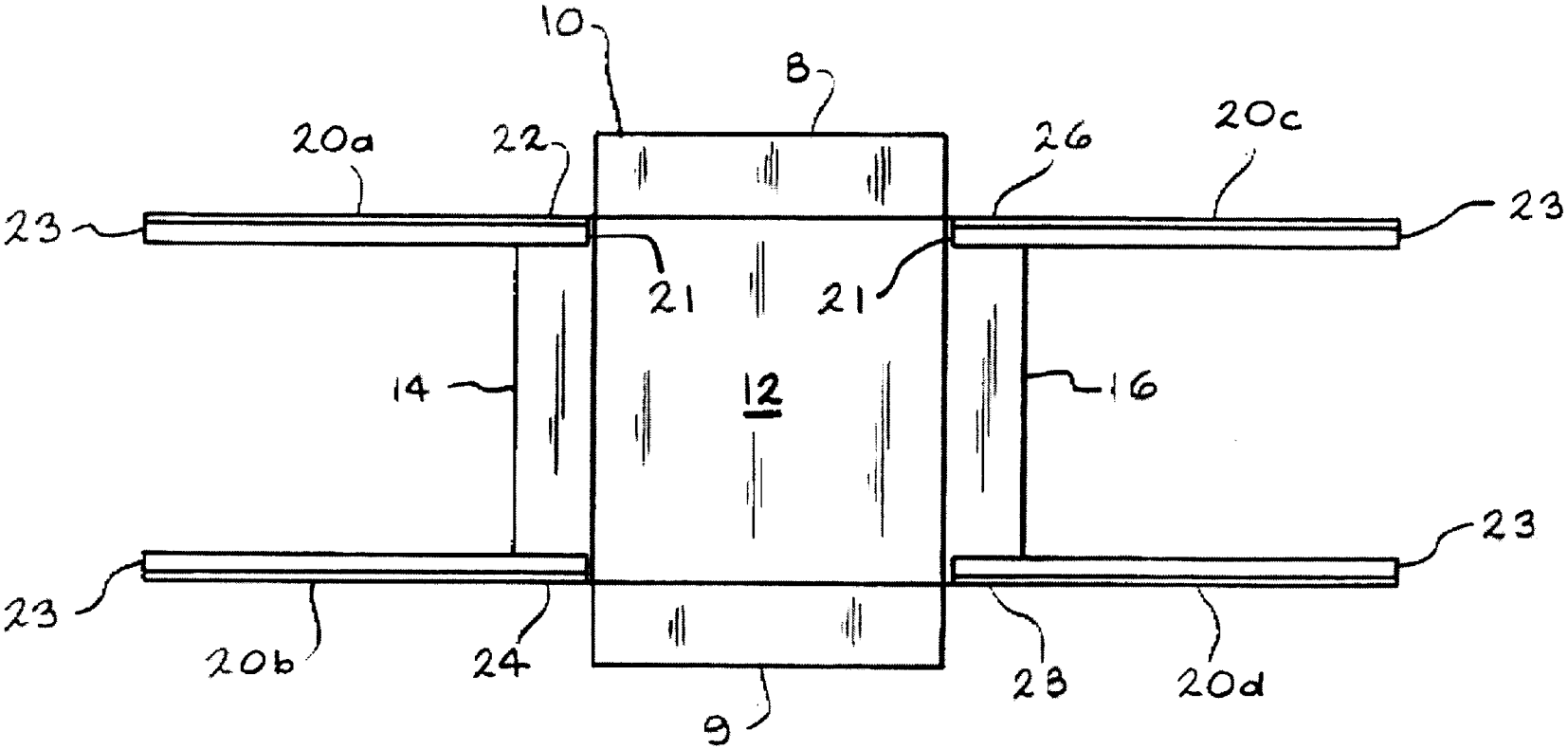
FIG. 1*a* is a plan view of a base and corner posts component of a shipping container in a first or planar position.

Referring now to the Figures, FIG. 1*a* shows a base 10 having a generally rectangular shape. However, it should be understood that other shapes having multiple sides can be used according to the present invention. For ease of illustration, a generally rectangular shape is shown. The base 10 is preferably made of a cardboard type material and has a center 12 for receiving an object such as an appliance. The base 10 has a first flap 14 and an opposing second flap 16 for receiving corner posts 20. The base further comprises opposing third and fourth flaps 18 and 19.

Each corner post 20 can have a desired predetermined geometry which allows the post to be secured against the object being shipped. One suitable type of corner post is made by Sonoco Products Company of Hartsville, S.C., such as the corner post shown in the Ortlieb U.S. Pat. No. 5,593,039 patent. It should be understood, however, that corner posts having other configurations are also useful with the present invention.

Each corner post 20 has a first end 21 and a second end 23. The first end 21 of a first corner post 20*a* is secured to an outside edge 22 of the first flap 14 using a suitable glue or adhesive material. A second corner post 20*b* is secured to a second edge 24 of the first flap 14. Similarly, a third corner post 20*c* is secured to a first edge 26 of the second flap 16 while a fourth corner post 20*d* is secured to a second end 28 of the second flap 16.

Figure 1B:
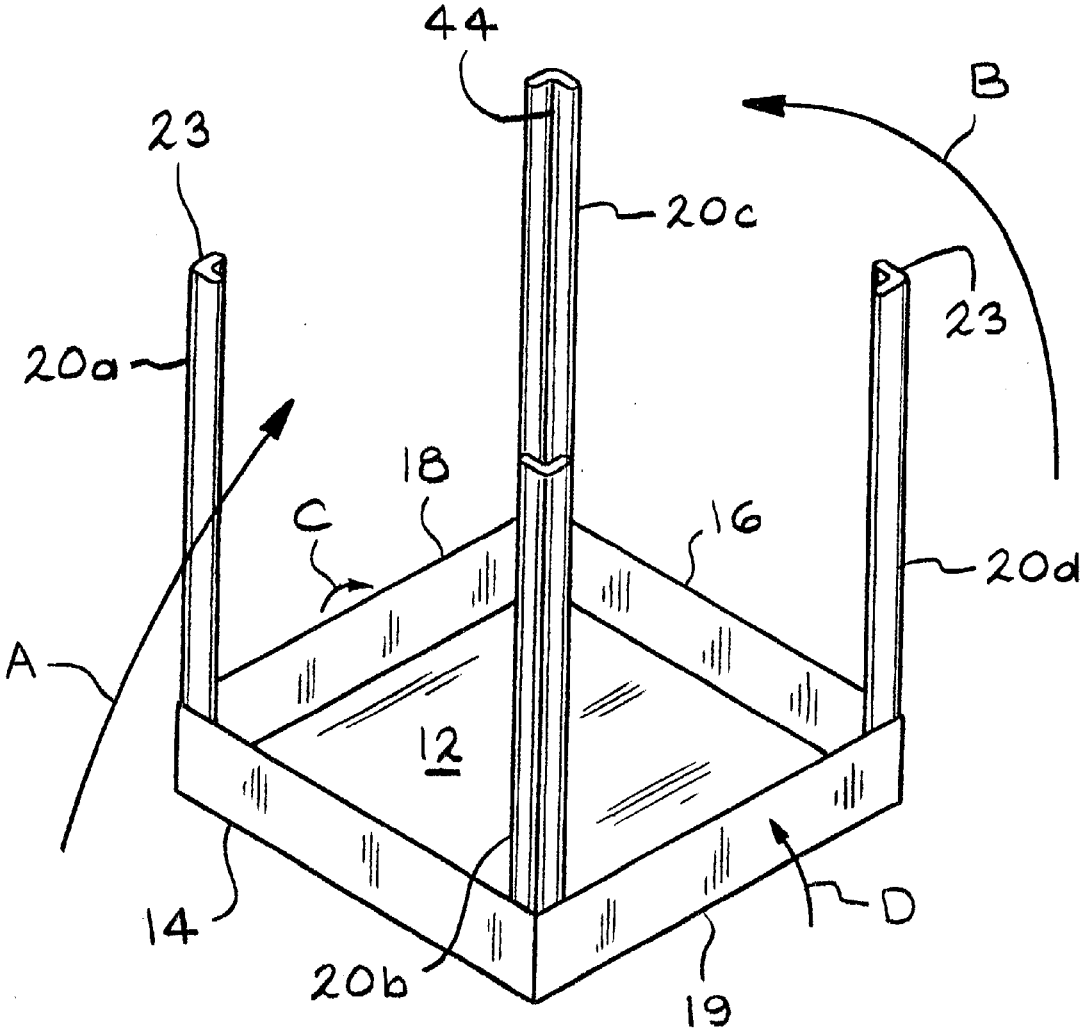
FIG. 1*b* is a perspective view of the base and corner posts component, as shown in FIG. 1, in a second or raised position.

Referring now to FIG. 1*b*, the first and second flaps 14 and 16 are moved in the direction as shown by arrows A and B such that the corner posts 20 are substantially perpendicular to the base center 12. In various embodiments, the opposing third and fourth flaps 18 and 19 can also be rotated in the direction as shown by arrows C and D to be perpendicular to the base center 12. However, the present invention can be practiced without rotation of the opposing flap members 18 and 19 into a perpendicular position during this stage of manufacturing of the shipping container.

Figure 2:
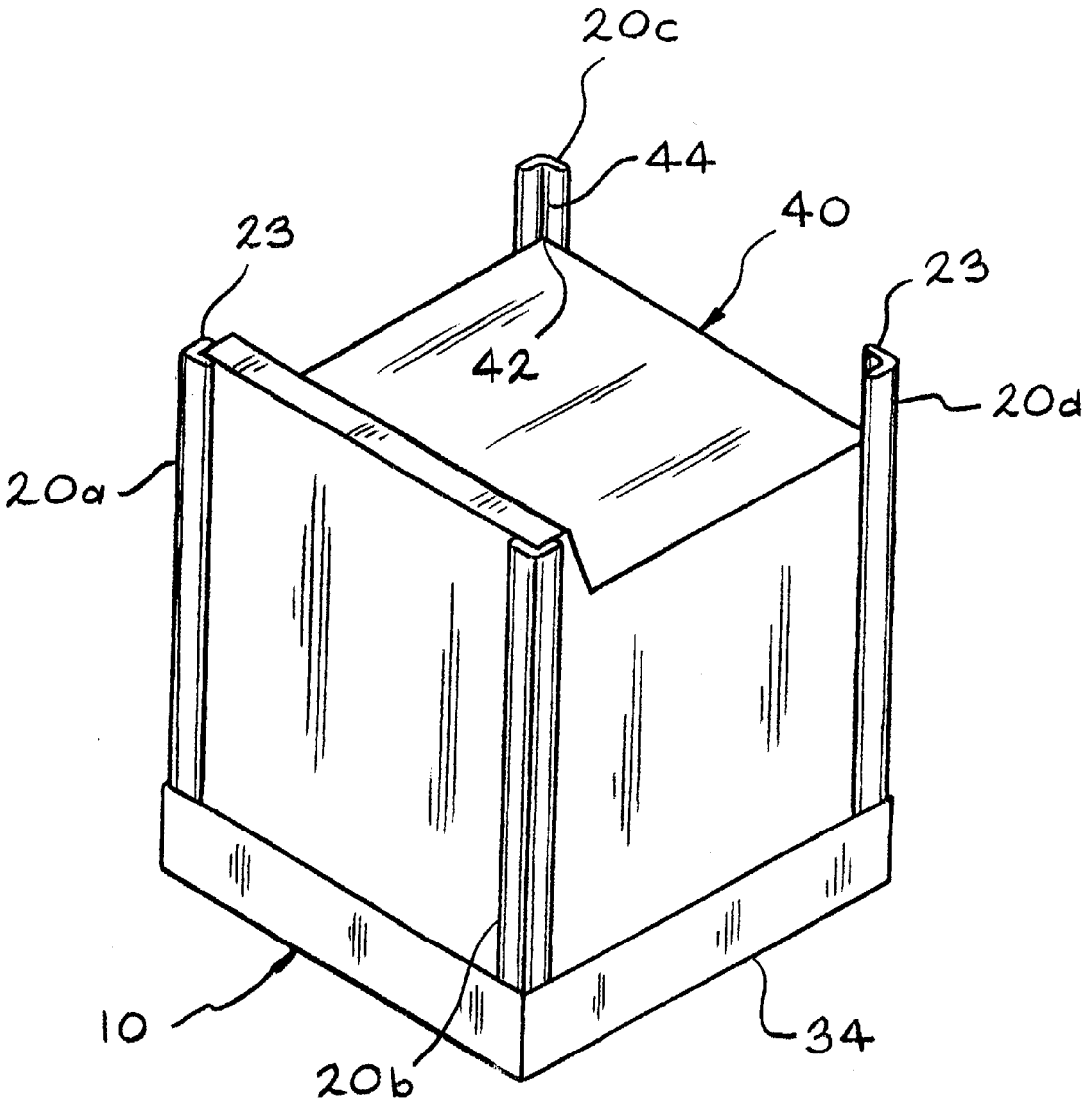
FIG. 2 is a perspective view of an object positioned on the base/corner post component of FIG. 1*b*.

FIG. 2 shows an object 40 positioned on the center 12 of the base 10. For ease of explanation, the object 40 is shown as an appliance, however, it should be understood that many different types of objects can be packaged using the method and apparatus of the present invention. In the embodiment shown, the object 40 generally has a rectangular shape and defines opposing corners 42. When the object 40 is placed on the base center 12, each of the corner posts 20*a*–20*d* is moved into a generally parallel relationship adjacent a corresponding corner 42 of the object 40.

It should be understood, that in preferred embodiments, each corner post 20 has a predetermined geometric cross-sectional configuration which provides support to the shipping container and which protects the object 40 being shipped. For ease of illustration, the corner posts 20 are generally shown as having an L-shape, having an interior corner or angle 44 engages the corner 42 of the object 40. However, it should be understood that, in certain embodiments, the corner posts 20 can have a more complex cross-sectional configuration and still define an interior corner 44 which engages the corner 42 of the object 40.

Figure 3A:
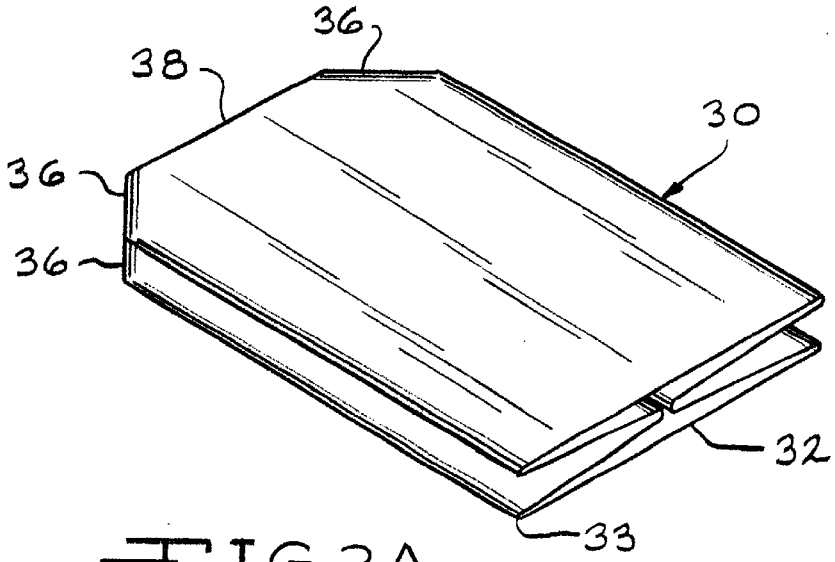
FIG. 3*a* is a perspective view of an open end of a removable flexible plastic material.
Figure 3B:
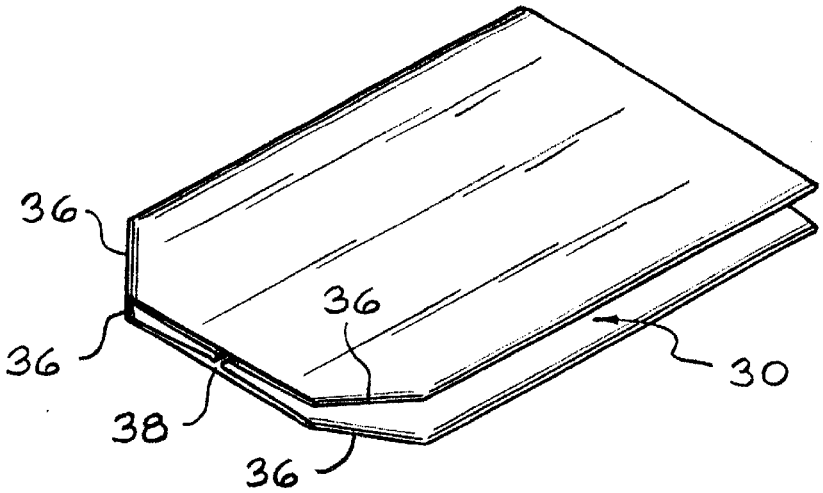
FIG. 3*b* is a perspective view of a removable flexible plastic material.
Figure 3C:
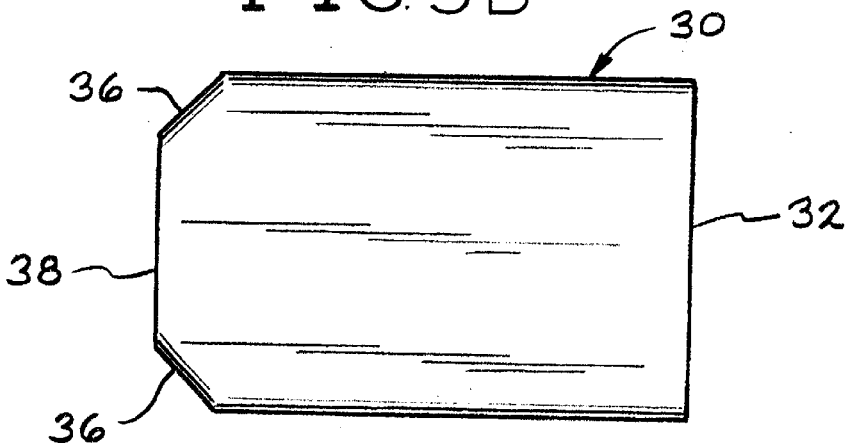
FIG. 3*c* is a plan view of a partially closed or sealed end of a removable flexible material.

FIGS. 3*a*–*c* show a transparent or translucent flexible plastic material 30. The flexible plastic material 30 preferably has a bag or sleeve type shape. The sleeve 30 has a first or open end 32 and a second end 34 (see FIG. 4). The second end 34 is at least partially closed or sealed in any suitable manner. It is to be further understood that all of the second end 34 of the sleeve 30 need not be totally closed. Rather, the second end 34 can comprise opposing sealed corners 36 and an open center area 38. In a preferred embodiment, the sleeve 30 can have a general shape similar to the object 40 being shipped. For example, if the object 40 has a generally rectangular shape, then the sleeve 30 can have a generally rectangular shape. it is desired that the sleeve 30 have a cross-sectional area that is at least slightly larger than, or can be stretched to be larger than, the cross-sectional area of the object 40 such that the object 40 can be positioned in the sleeve 30, as will be further explained in detail below. When the sleeve 30 has definite cross-sectional shape, such as a triangle, rectangle or square, and the like, the sleeve 30 defines a plurality of corners 33. However, it should be understood that the sleeve can have a generally cylindrical shape and, thus, not have any defined corners.

The base 10 and corner posts 20*a*–20*d* component is positioned within the sleeve 30. In certain embodiments, as explained in detail below, the open end 32 of the sleeve 30 is held open while the base 10/corner posts 20*a*–20*d* component and the object 40 are slideably positioned in the sleeve 30.

Figure 4:
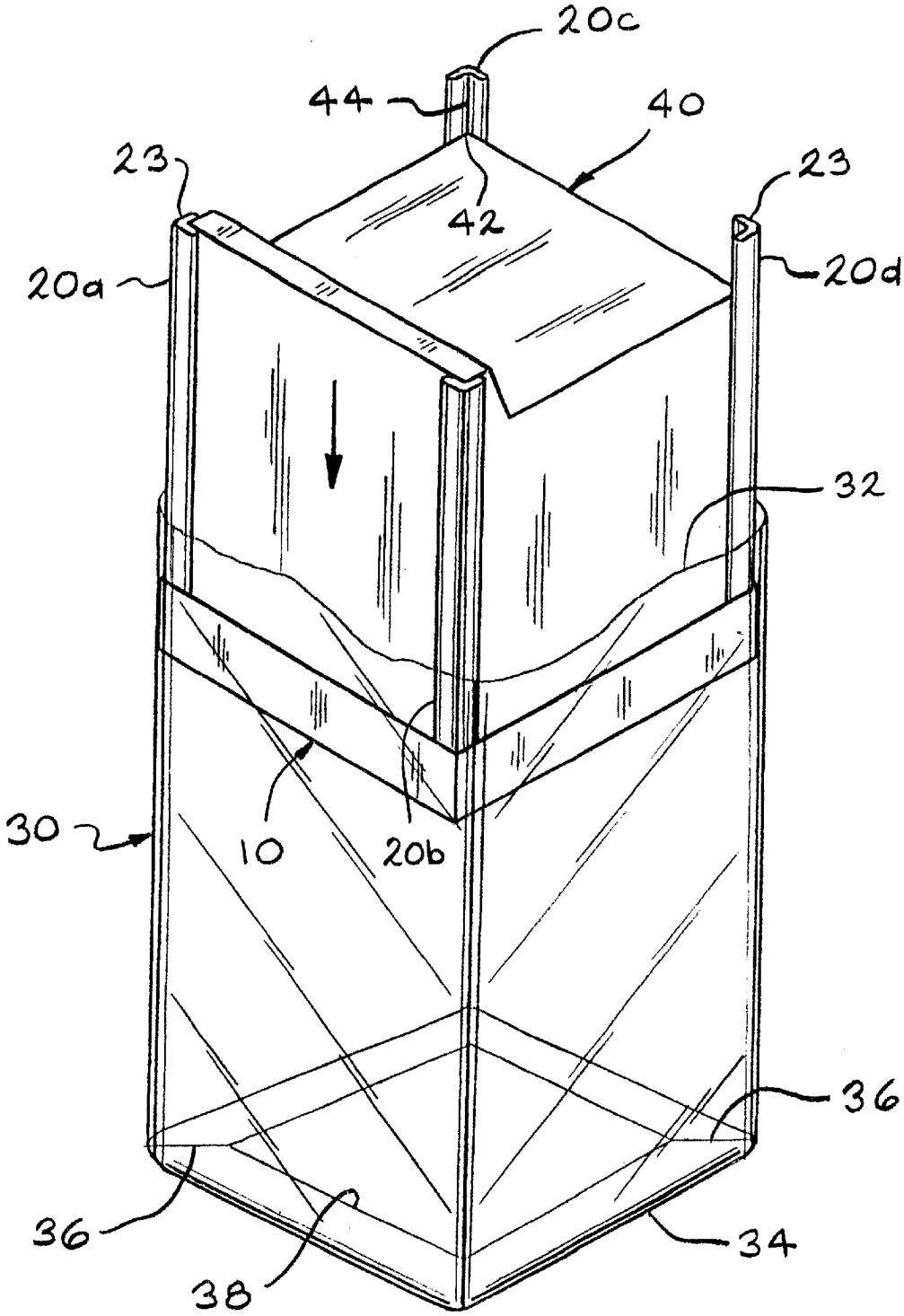
FIG. 4 is a perspective view showing a base/corner posts shipping container component or assembly and an object being placed in the flexible material.

As shown in FIG. 4, the base 10/corner posts 20*a*–20*d* component and the object 40 are slideably moved into the sleeve 30 until the base 10 comes into contact with the second end 32. The sealed corners 36 of the second end 32 prevent the base 10/corner posts 20*a*–20*d* component and the object 40 from falling through the sleeve 30.

Figure 5:
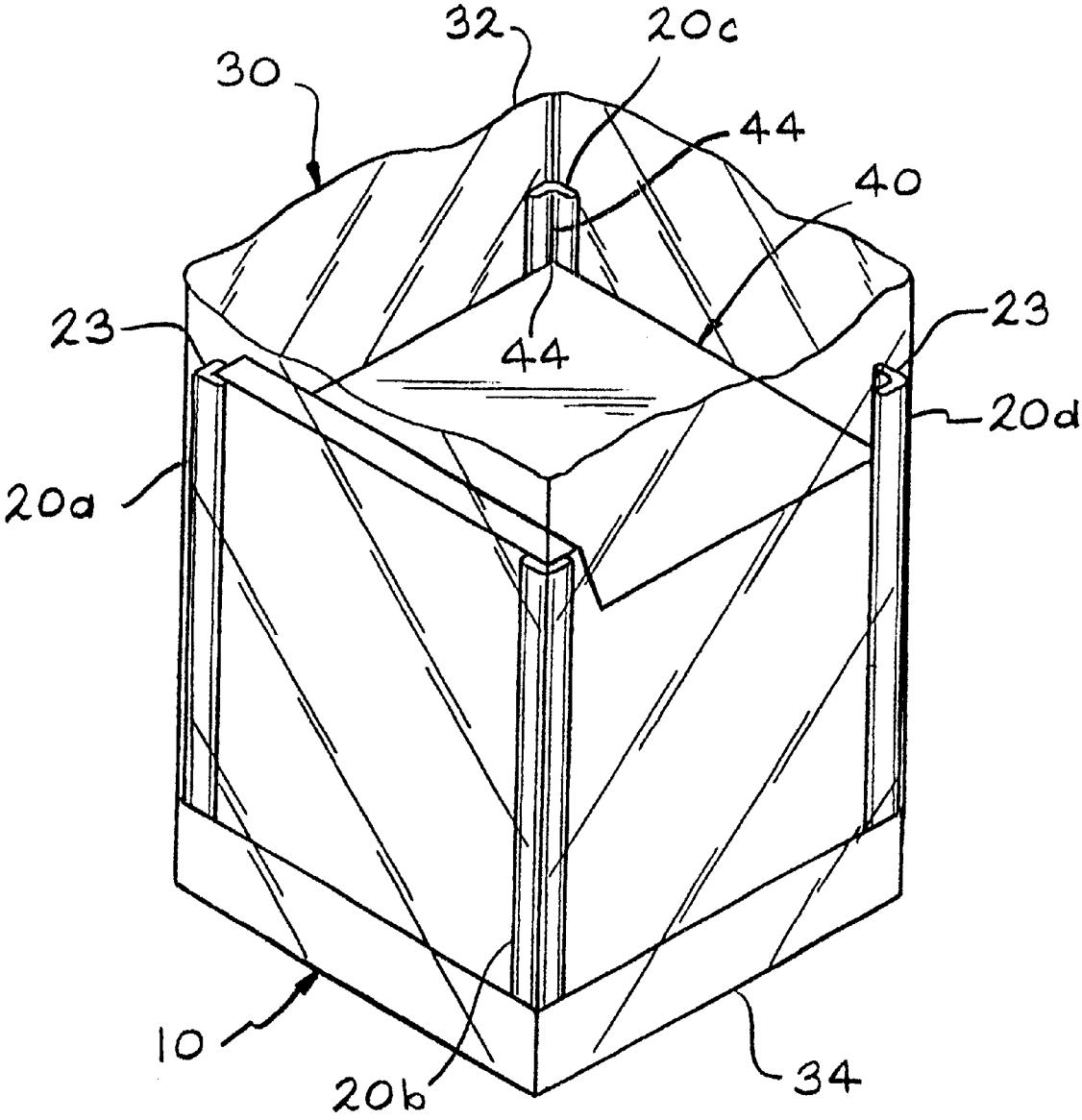
FIG. 5 is a perspective view of an object secured within the shipping container component shown in FIG. 4.

FIG. 5 shows the object 40 in position in the sleeve 30 adjacent the base 10. The corner posts 20*a*–20*d* extend along the corners 42 of the object 40, protecting the corners 42 of the object 40. In a preferred embodiment, the open end 32 of the sleeve 30 extends beyond the second ends 23 of the corner posts 20.

Figure 6:
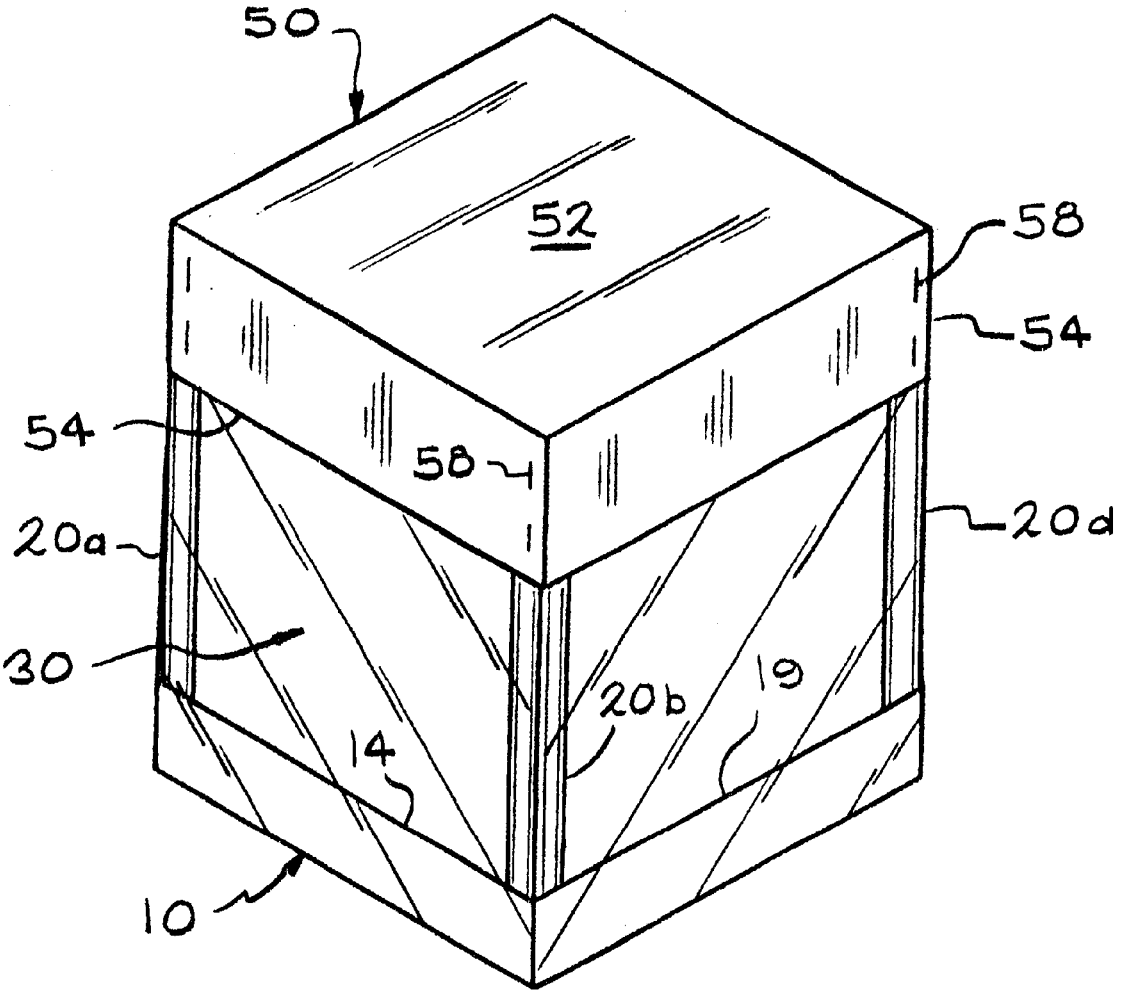
FIG. 6 is a perspective view showing the object secured within the shipping container and having a top positioned on the container.

FIG. 6 shows a top 50 which is removably secured to the posts 20 and the sleeve 30. The top 50 generally has a complementary shape to the base 10. The top 50 has a center 52 and a plurality of flaps 54. Each flap 54 is folded in a downward direction from the center 52. The flaps 54 are folded in a generally perpendicular direction away from the center 52 such that the flaps fold over the second end 23 of each corner post 20. The top 50 can be removably secured to each second end 23 of each post 20 by any suitable securing member 58, including stapling. Other securing members, such as screws or nails can also be used.

If access to the object 40 is desired after the object is secured within the shipping container, the securing members 58 are removed, and the top 50 is removed. The sleeve 30 is slideably moved in a downward direction along the posts 20 so that access can be gained to all parts of the object 40. After any inspection work or repair is done to the object 40, the sleeve 30 is slideably moved or repositioned adjacent the posts 20 such that the open end 32 of the sleeve 30 terminates at a point adjacent and in close proximity to the second end 23 of each post 20. Thereafter, the top 50 is again secured to the posts 20.

Figure 7:
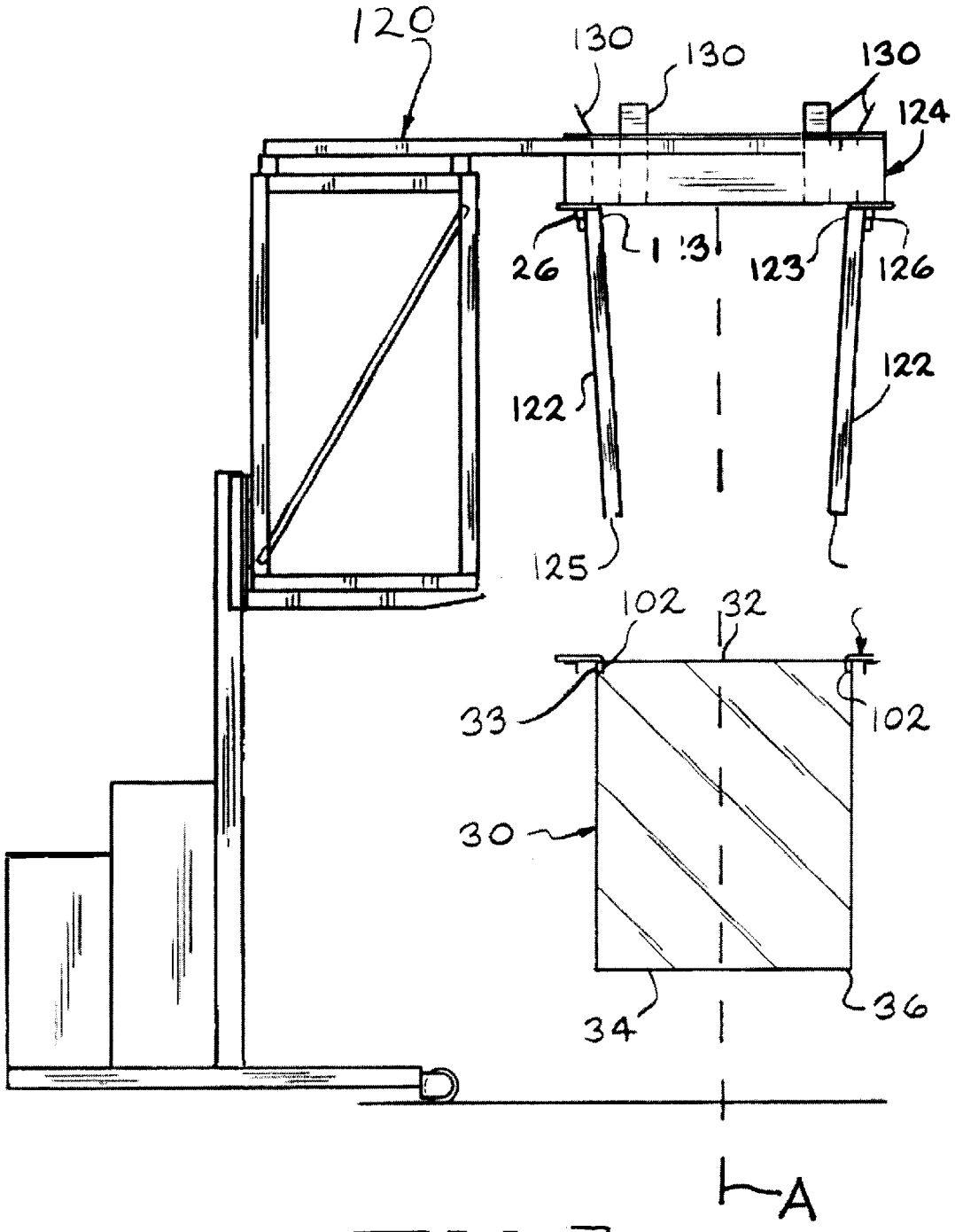
FIG. 7 is a schematic view, partially in phantom, showing a first step in producing a transparent and removable shipping container.

Referring now to FIGS. 7–11, a method and apparatus for placing an appliance in the shipping container are generally shown. FIG. 7 is schematic view, partially in phantom, showing the sleeve 30 held in an open position by a sleeve transfer or first means 100. The sleeve transfer means 100 has at least one, and preferably a plurality of holding members 102 which engage a portion of the open end 32 of the sleeve 30. The holding members 102 engage the corners 33 of the sleeve 30 and hold the sleeve 30 in an open position. It should be understood that when the sleeve 30 has a generally cylindrical shape, the holding members 102 engage points along the open end 32 of the sleeve 30 such that the object can be readily positioned in the sleeve 30.

Referring again to FIG. 7, the sleeve 20 is brought into coaxial alignment with a sleeve securing or second means 120 along axis A. The sleeve securing means 120 has a plurality of downwardly extending securing members or forks 122 which are generally positioned at opposing corners of a frame 124. Each fork 122 is operatively connected at a first or proximal end 123 to the frame 124 by a tension member 126 such as a spring or the like. Each tension members 126 holds a corresponding securing form 122 in tension and at an acute angle with respect to the frame 124. Each fork 122 further defines a distal end 125 which is in a spaced apart relationship to the proximal end 123 of the fork and the frame 124.

The sleeve securing means 120 further comprises a plurality of angled guide members 130 which extend from the frame 124 in a direction opposite to the securing forks 122. The angled guide members 130 extend at an acute angle with respect to the frame 124. As will be explained in detail below, the angled guide members 130 aid in aligning the object 40 in a coaxial relationship with the forks 122 and the sleeve 30.

Figure 8:
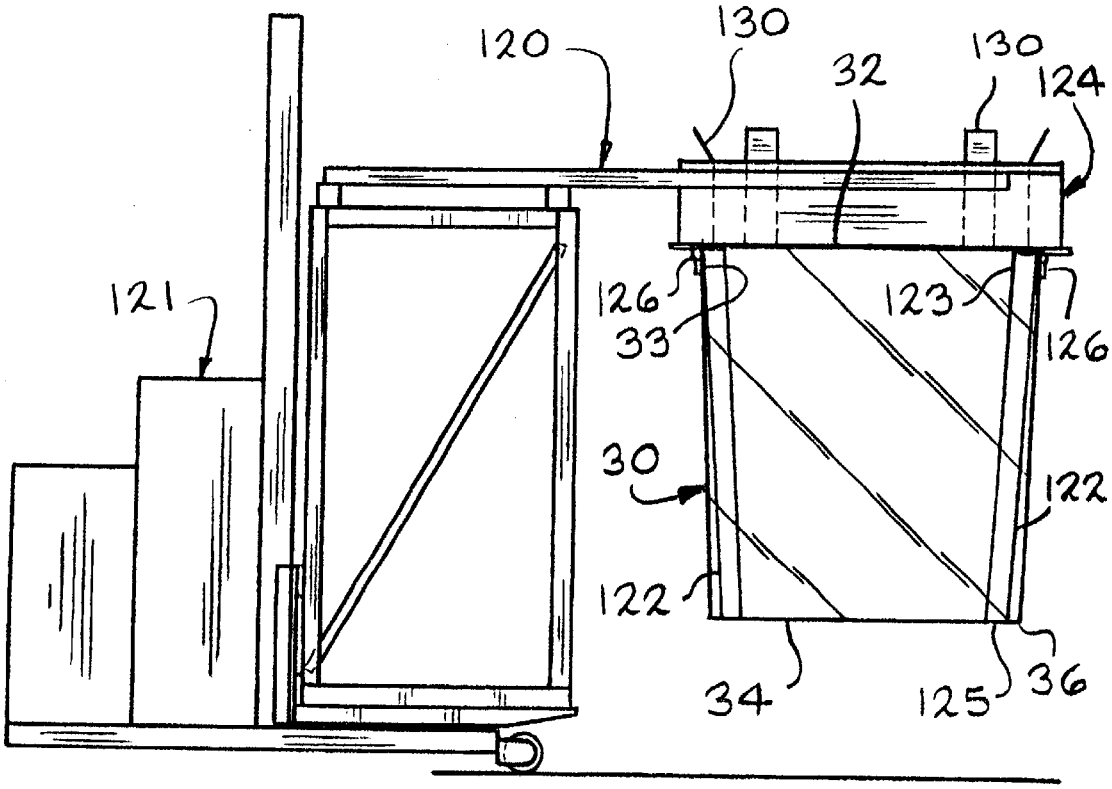
FIG. 8 is a schematic view, partially in phantom, showing a second step in producing a transparent and removable shipping container.

The sleeve securing means 120 is positioned in a coaxial relationship with the sleeve transfer means 100. The sleeve securing means 120 has a power source 121, whereby the sleeve securing means 120 is moved from a first position, as shown in FIG. 7, to a second position, as shown in FIG. 8. When the sleeve securing means 120 is moved to the second position, the securing forks 122 pass through the open end 32 of the sleeve 30 and are extended into the sleeve 30. When the sleeve 30 has corners 33, it is desired that the securing forks 122 engage at least the portions of the interior of the corners 33 which are adjacent the open end 32 of the sleeve 30. As seen in FIG. 8, because the tension members 126 hold the securing forks 122 at an angle with respect to the frame 124, the distal ends 125 of the forks 122 are in a spaced apart relationship to the bottom corners 36 of the sleeve 30. However, the sleeve 30 is secured against at least the proximal ends 123 of the forks 122.

Figure 9:
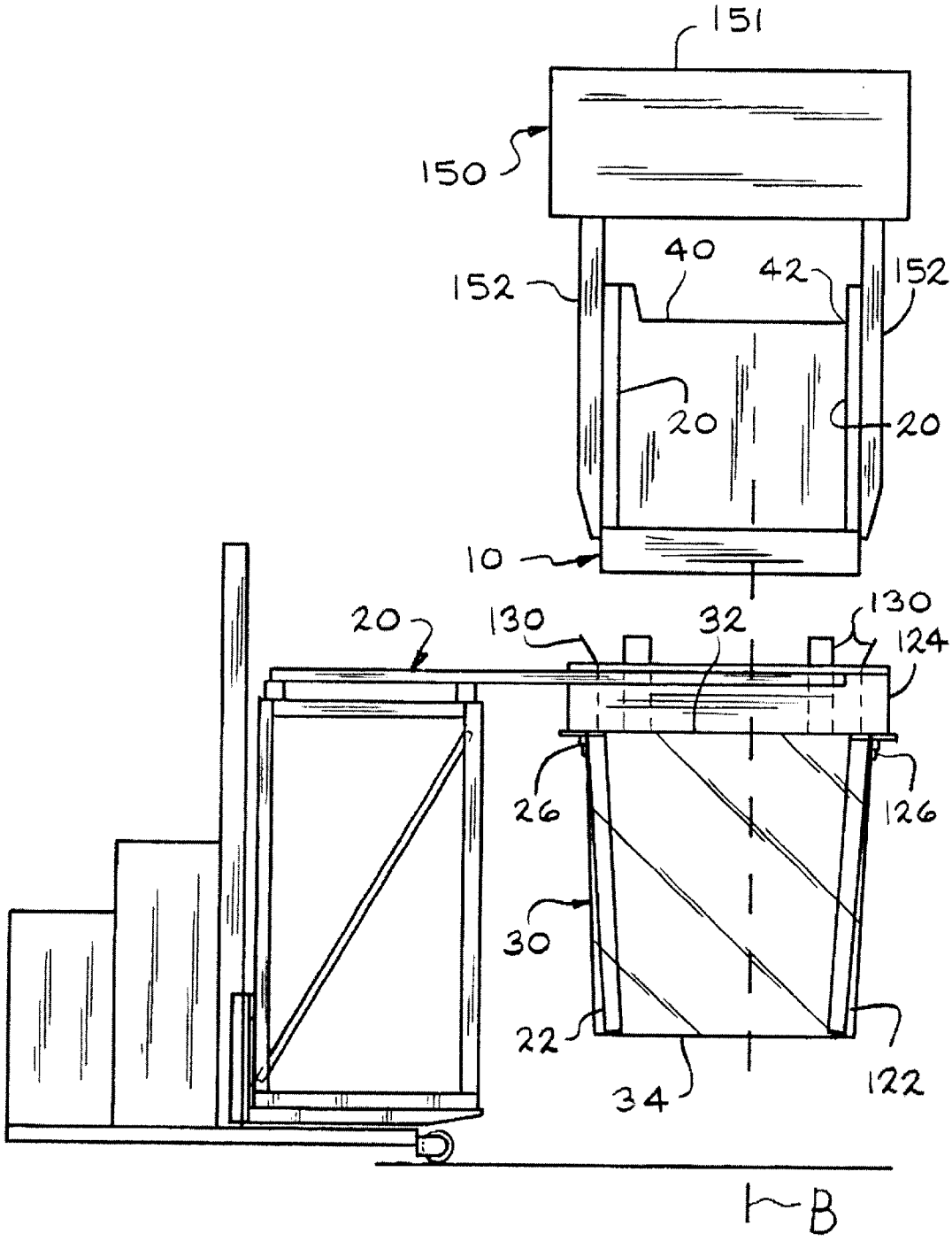
FIG. 9 is a schematic view, partially in phantom, showing a third step and showing an object ready to be positioned within a flexible plastic material.

The object 40 is positioned on the base 10/corner posts 10*a*–20*d* component in a suitable manner (not shown) such as by a conveyor system or the like. Referring now generally to FIG. 9, a positioning or third means 150 which has a plurality of clamping arms 152 engages the object 40 and the base 10/corner posts 20*a*–20*d* component.

The positioning means 150 may have any suitable clamping or securing arms 152 which can be pneumatically or hydraulically operated to releasably secure the object 40. The corner posts 20 are held securely against the corners 42 of the object 40 by the positioning means 150. The positioning means 150 is positioned to be into coaxial alignment with the sleeve securing means 120 and the sleeve 30.

Figure 10:
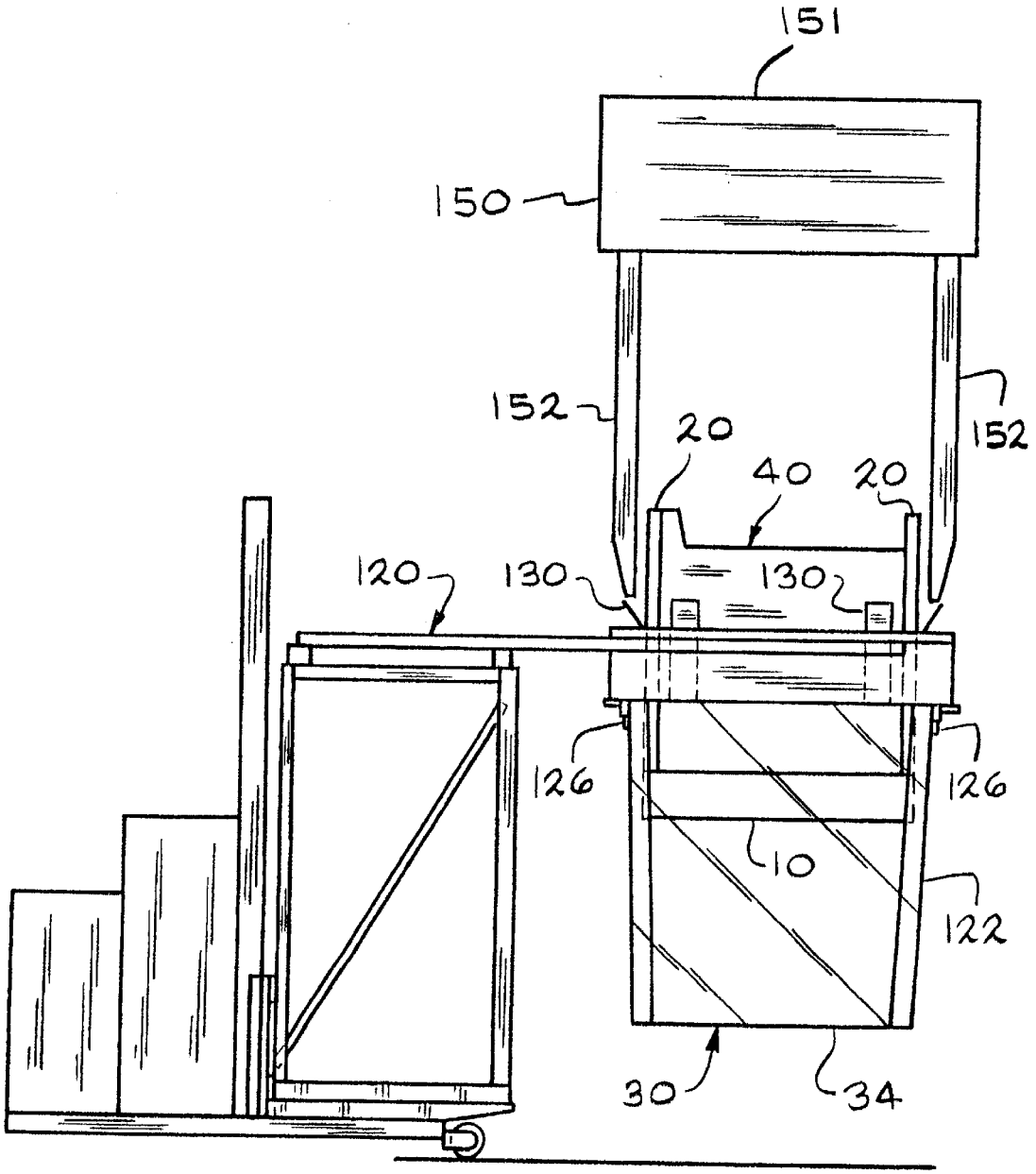
FIG. 10 is a schematic view, partially in phantom, showing the object being positioned in the flexible plastic material of the shipping container.

The positioning means 150 has a power source 151, whereby the clamping arms 152 are moved from a first position, as shown in FIG. 9, to a second position, as shown in FIG. 10. In the first position, the positioning means 150 is brought into alignment with the guide members 130 along axis B. The object 40/base 10/corner posts 20*a*–20*d* component is positioned to be in alignment with and adjacent the guide members 130.

In operation, the clamping arms 152 are disengaged, thus allowing the object 40/base 10/posts 20*a*–20*d* component to be slideably positioned within the sleeve 30. The corner posts 20*a*–20*d* contact the forks 122. The weight and momentum of the object 40 being dropped into the sleeve 30 acts on the forks 122 such that the tension members 126 absorb at least a part of the weight of the object 40. The forks 122 are moved into a substantially parallel alignment with the corner posts 20. The second end 34 of the sleeve 30 prevents the object 40 from breaking through or dropping beyond the second end 34 of the sleeve 30.

Figure 11:
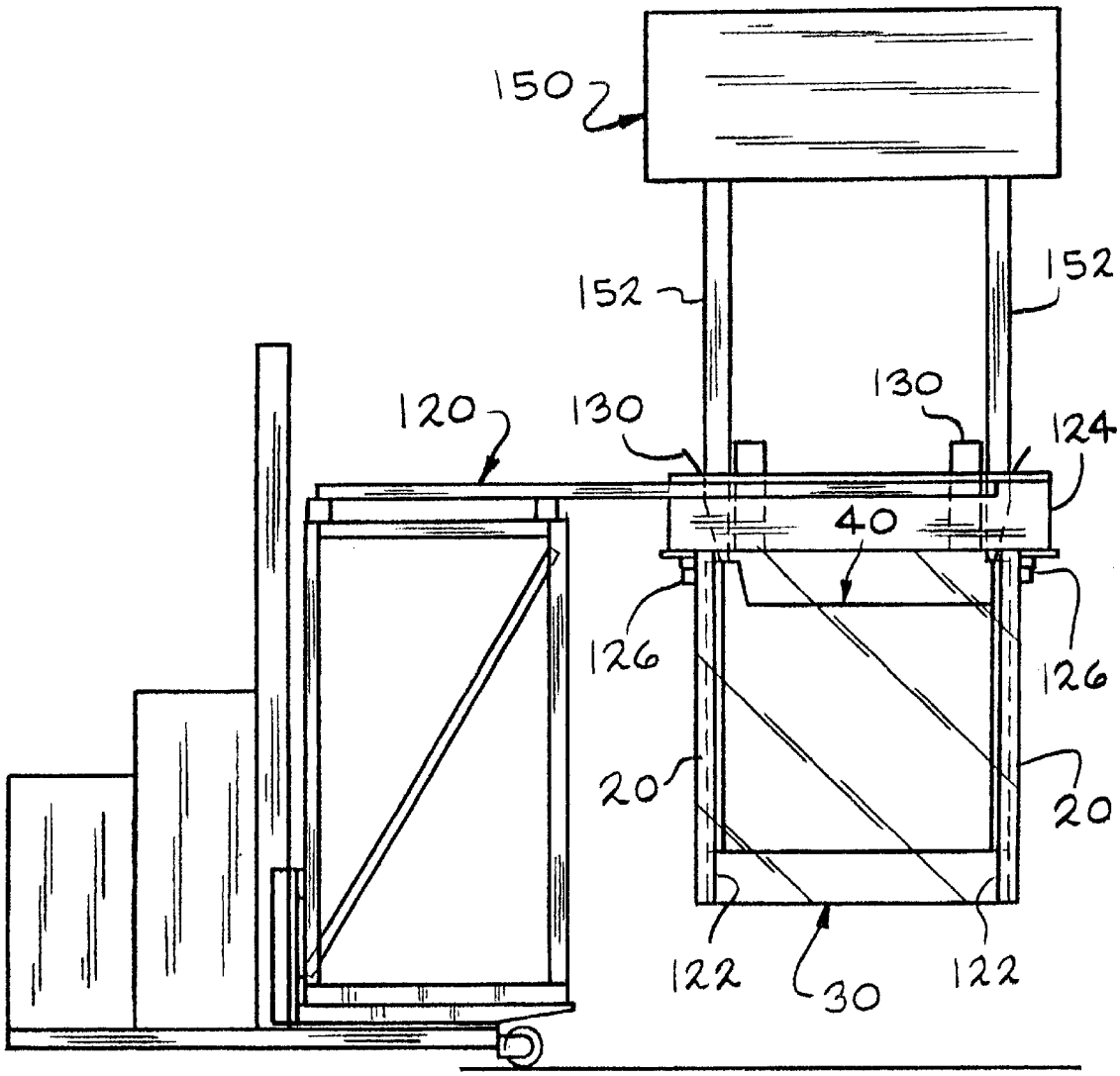
FIG. 11 is a schematic view, partially in phantom, showing the object fully positioned in the shipping container.

As an additional feature, the clamping arms 152 are moved from the second position, as shown in FIG. 10, to a third position, as shown in FIG. 11 by the power source 151. The positioning means 150 and the clamping arms 152 are moved in a direction toward the object 40. The clamping arms 152 are moved into contact with at least two opposing corner posts 20. The positioning means 150 advances the clamping arms 152 in a direction toward the object 40 such that the object 40 can be further guided into the sleeve 30, if necessary. It is to be understood that the positioning means 150 and the sleeve securing means 120 can be operated in any suitable manner and can be moved by hydraulics or pneumatic devices.

Figures 12, 13:
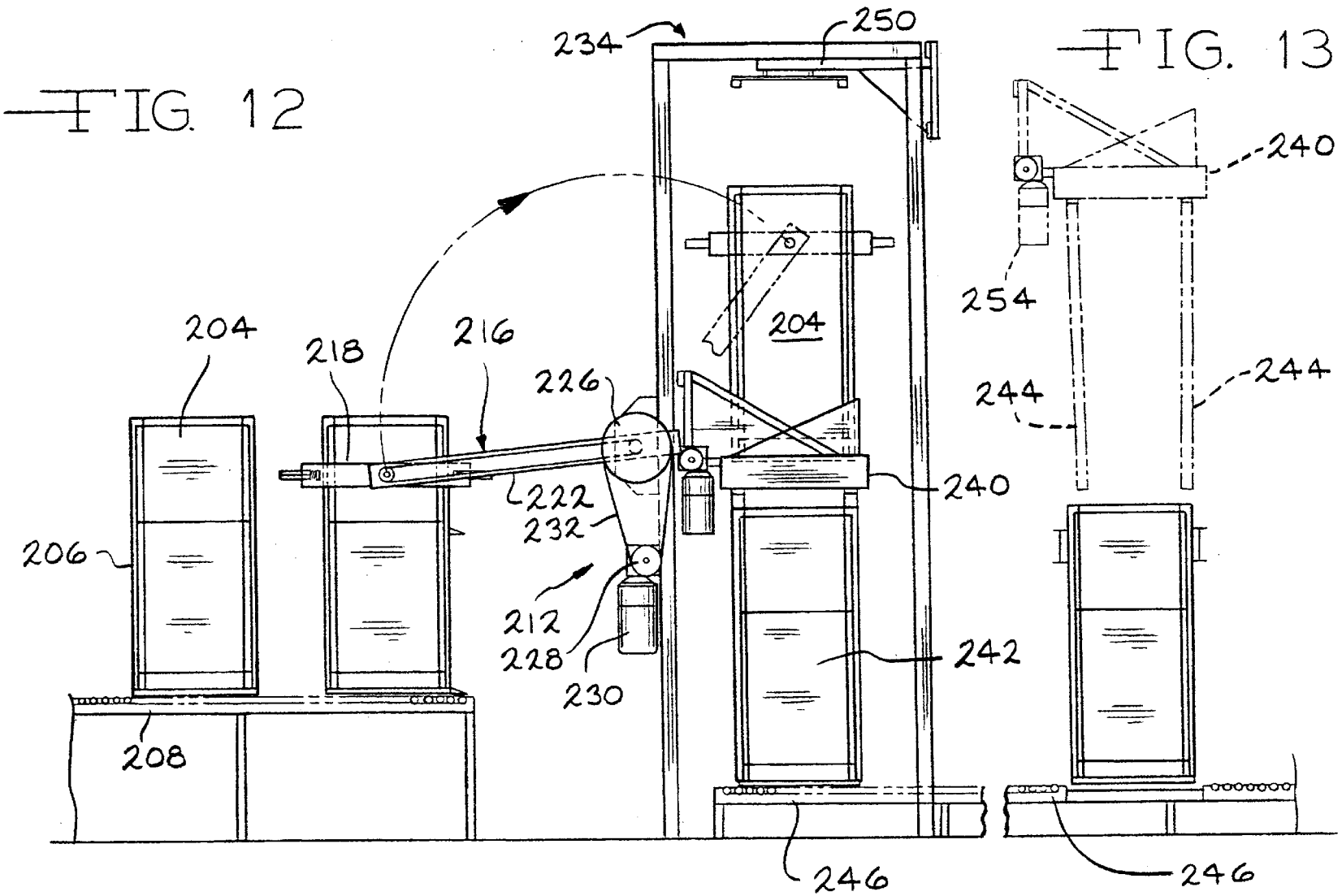
FIG. 12 is a schematic view, partially in phanton, showing the object being removed from a conveyor to a position above the shipping container.
FIG. 13 is a schematic view, partially in phanton, showing the object positioned in the shipping container and mounted on a transfer conveyor.

FIGS. 12 and 13 show additional embodiments of the present invention. An object 204 that is to be placed in a sleeve 242 is advanced along a conveyor 208 to a transfer mechanism 212. The transfer mechanism includes a positioning means 216 that has at least two opposed clamping or securing arms 218 that are used to engage and securely hold the object 204. The clamping arms 218 are usually operated by a fluid pressure to cause the clamping arms to releasably engage the object 204. The clamping arms 218 and positioning means 216 are substantially the same as the previously described positioning means 150 and clamping arms 152 and function in substantially the same way when engaging the object 204 by the corner posts 206 that are positioned along the corners of the object 204.

Each clamping arm 218 is pivotally secured to one end of a transfer arm 222. The transfer arm is pivotally secured to each clamping arm 218 at substantially the midpoint of the clamping arm. The second end of the transfer arm 222 is secured to a pulley or sprocket 226. The pulley or sprocket 226 is operatively connected to a drive pulley or drive sprocket 228. The drive pulley or sprocket is operatively connected to a motor 230. A chain or belt 232 is used to operatively connect the drive pulley 228 to the pulley 226 on the second end of the transfer arm 222.

In operation, the motor 230 is activated to cause the drive pulley 228 to rotate wherein the belt 232 is caused to advance which in turn causes the pulley 226 to rotate. The rotation of the pulley 226 causes the transfer arm 222 to rotate with the pulley 226 whereby the transfer arm 222 and clamping arms 218 are caused to move in a clockwise direction. The object 204 held in the clamping arms 218 is lifted from the conveyor 208 and transferred to a packaging station 234. In the packaging station 234, the object 204 is held by the clamping arms 218 immediately above a sleeve securing means 240 which is substantially similar to the sleeve securing means 120 previously described. When the object 204 is properly positioned over the sleeve securing means 240, the clamping arms 218 are moved to release the object 204 and the object 204 falls through the force of gravity into the sleeve securing means 240 and into the plastic sleeve 242 positioned on the sleeve securing means 240 in the manner previously described above. When the object 204 is completely positioned in the plastic sleeve 242, the object 204 will be resting upon a transfer conveyor 246.

A pusher device 250 is usually positioned above the object 204 in the packaging station 234. The pusher device 250 can be advanced toward the object 204 so that it engages the surface of the object 204 that is spaced apart from the sleeve securing means 240. The pusher device 250 can be biased in a manner that it acts upon the object 204 to move the object 204 in a direction toward the plastic sleeve 242. The pusher device 250 moves vertically to assist the object 204 in advancing into the plastic sleeve 242 so that the object 204 is completely inserted into the plastic sleeve 242.

In FIG. 13, the sleeve securing means 240 is advanced vertically in a direction away from the transfer conveyor 246 to remove the forks 244 from the plastic sleeve 242 to complete the packaging of the object 204 in the plastic sleeve 242. The sleeve securing means 240 has a positioning motor 254 that engages a rack or cable (not shown) positioned adjacent the packaging station 234 to remove the forks 244 from the plastic sleeve 242. Once the forks 244 are removed from the plastic sleeve 242, the object 204 packaged in the plastic sleeve 242 can be advanced along transfer conveyor 246 for moving to another location.

The present invention provides a method and apparatus for providing an economical and easy to use shipping container. The method of placing the object within the shipping container is readily automated to permit high speed and economical packing and shipping of large objects.

The invention has been shown and described with respect to the particular embodiments thereof for the purpose of illustration rather than limitation. Other variations and modifications of the specific embodiment herein shown and described will be apparent to those skilled in the art within the intended spirit and scope of the invention.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

What is claimed is:

1. An apparatus for removably packaging an object in a shipping container without damaging the shipping container, the shipping container having a base for receiving the object; a plurality of corner posts for protecting corners of the object, each post having a first end affixed to a portion of the base and a second, opposed end in a spaced apart relationship to the base, the base and corner posts forming a base-corner posts component; and, a flexible sleeve material removably positioned over the base and corner posts component, the flexible sleeve material being capable of being removed from and replaced on the base-corner posts component without being torn or destroyed, the apparatus comprising:

a means for positioning the object on the base-corner posts component to form an assembled object-base-corner posts component, a first means for holding the flexible sleeve material in an open position, the flexible sleeve material having a cross-sectional area that is stretchable to be larger than the cross-sectional area of the assembled object-base-corner post component;

a second means for engaging the opened flexible sleeve material, wherein the second means is in a coaxial position with the first means, the second means being moveable from a first position to a second position for engaging the opened flexible sleeve material; and, a third means for engaging the object-base-corner posts component and for disengaging the object-base-corner posts component into the flexible sleeve material.

2. The apparatus of claim 1, wherein the second means comprises at least one securing fork which releasably engages the flexible sleeve material.

3. The apparatus of claim 2, wherein the securing fork is held under tension by at least one tension member.

4. The apparatus of claim 1, wherein the third means is in a coaxial position with the second means, the third means being moveable from a first position to a second position, thereby disengaging the object-base-corner posts component into the flexible sleeve material.

5. The apparatus of claim 4, wherein the third means comprises clamping arms which engage and disengage from the object and the base and corner posts component.

6. The apparatus of claim 5, wherein the third means further comprises guide members for aligning the object-base-corner posts component with the second means and the flexible sleeve material.

7. An apparatus for packaging an object in a shipping container, the shipping container having a base for receiving the object; a plurality of corner posts for protecting corners of the object, each post having a first end affixed to a portion of the base and a second, opposed end in a spaced apart relationship to the base;

the apparatus comprising:

a means for assembling the object onto the base and the corner posts, a sleeve holding means for holding a flexible sleeve material in an open position wherein the flexible sleeve material has an at least partially closed second end having opposing sealed corners and an open center area adjacent the base and an opposed, open first end through which the object is placed, the flexible sleeve material having a cross-sectional area that is stretchable to be larger than the cross-sectional area of the assembled object-base-corner post component;

a sleeve engagement means for engaging the opened flexible sleeve material; and an engaging/disengaging means for simultaneously engaging the object and the base and corner posts and for simultaneously disengaging the object and the base and corner posts into the flexible sleeve material whereby the flexible sleeve material is removably positioned over the base and corner posts, the flexible sleeve material being capable of being removed from and replaced on the base and corner posts without being torn or destroyed.

8. The apparatus of claim 7, wherein the at least partially closed second end defines sealed corners.

9. An apparatus for packaging an object in a shipping container, the shipping container having a base for receiving the object; a plurality of corner posts for protecting corners of the object, each post having a first end affixed to a portion of the base and a second, opposed end in a spaced apart relationship to the base; and, a flexible sleeve material removably positioned over the base and corner posts, the flexible sleeve material being capable of being removed from and replaced on the base and corner posts without being torn or destroyed;

the apparatus comprising:

a means for assembling the object onto the base and the corner posts wherein the base further defines first and second foldable flaps, a sleeve holding means for holding the flexible sleeve material in an open position, the flexible sleeve material having a cross-sectional area that is stretchable to be larger than the cross-sectional area of the assembled object-base-corner post component;

a sleeve engagement means for engaging the opened flexible sleeve material; and an engaging/disengaging means for simultaneously engaging the object and the base and corner posts and for simultaneously disengaging the object and the base and corner posts into the flexible sleeve material.

10. An apparatus for packaging an object in a shipping container, the shipping container having a base for receiving the object; a plurality of corner posts for protecting corners of the object, each post having a first end affixed to a portion of the base and a second, opposed end in a spaced apart relationship to the base; and, a flexible sleeve material removably positioned over the base and corner posts, the flexible sleeve material being capable of being removed from and replaced on the base and corner posts without being torn or destroyed;

the apparatus comprising:

a means for assembling the object onto the base and the corner posts, wherein each corner post is affixed to an outer edge of the base, a sleeve holding means for holding the flexible sleeve material in an open position, the flexible sleeve material having a cross-sectional area that is stretchable to be larger than the cross-sectional area of the assembled object-base-corner post component;

a sleeve engagement means for engaging the opened flexible sleeve material; and an engaging/disengaging means for simultaneously engaging the object and the base and corner posts and for simultaneously disengaging the object and the base and corner posts into the flexible sleeve material.

11. An apparatus for packaging an object in a shipping container, the shipping container having a base for receiving the object; a plurality of corner posts for protecting corners of the object, each post having a first end affixed to a portion of the base and a second, opposed end in a spaced apart relationship to the base; and, a flexible sleeve material removably positioned over the base and corner posts, the flexible sleeve material being capable of being removed from and replaced on, the base and corner posts without being torn or destroyed;

the apparatus comprising:

a means for assembling the object onto the base and the corner posts, a sleeve holding means for holding the flexible sleeve material in an open position, wherein the flexible material is at least translucent thereby allowing viewing of the object;

a sleeve engagement means which engages the opened flexible sleeve material; and an engaging/disengaging means for simultaneously engaging the object and the base and corner posts and for simultaneously disengaging the object and the base and corner posts into the flexible sleeve material.

12. An apparatus for removably packaging an object in a shipping container without damaging the shipping container, the apparatus comprising:

a positioning means for positioning an object onto a base-corner post component;

a first means for holding a flexible sleeve material in an open position, the flexible sleeve material having a cross-sectional area that is stretchable to be larger than the cross-sectional area of the assembled object-base-corner post component;

a second means comprising a plurality of securing forks for engaging the opened flexible sleeve material, the second means being in a coaxial position with the first means, the second means being moveable from a first position to a second position for engaging the opened flexible sleeve material; and, a third means for engaging the object-base-corner posts component and for disengaging the object-base-corner post component into the flexible sleeve material, the third means comprising clamping arms which engage and disengage from the object-base-corner posts component, the third means being in a coaxial position with the second means, the third means being moveable from a first position to a second position, thereby disengaging the object-base-corner posts component into the flexible sleeve material.

13. The apparatus of claim 12, wherein the third means further comprises guide members for aligning the object-base-corner posts component with the second means and the flexible sleeve material.

14. The apparatus of claim 12, wherein the first means has at least one holding member which engages a portion of an open end of the flexible sleeve material.

15. The apparatus of claim 12, wherein the plurality of securing forks are positioned at opposing corners of a frame, each fork being operatively connected to the frame by a tension member.

16. The apparatus of claim 15, wherein the second means further comprises a plurality of angled guide members extending from the frame in a direction opposite to the securing forks.

17. The apparatus of claim 16, wherein the second means is operatively connected to a power source whereby when the second means is moved from the first position to the second position, the securing forks pass through the open end of the flexible sleeve material and the tension members hold the securing forks in a spaced apart relationship to a second end of the flexible sleeve material, wherein the second end of the flexible sleeve material defines a plurality of sealed corners.

18. The apparatus of claim 17, wherein the third means is operatively connected to a power source for moving the clamping arms from an engaged position to a disengaged position whereby the object-base-corner posts component is slideably positioned within the flexible sleeve material, the object-base-corner posts component contacting the forks and causing the forks to be moved into a substantially parallel alignment with the corner posts such that the tension members at least absorb a part of the weight of the object-base-corner post component.

* * * * *